US005109756A

United States Patent [19]

Barboza et al.

[11] Patent Number: 5,109,756

[45] Date of Patent: May 5, 1992

[54] ADJUSTABLE AIR DIFFUSER WITH QUICK MOUNTING MEANS

[76] Inventors: Scott M. Barboza, 1319 Sharps Lot Rd.; Michael A. Moore, 401 Stevens Rd., both of, Swansea, Mass. 02777

[21] Appl. No.: 646,211

[22] Filed: Jan. 28, 1991

[51] Int. Cl.[5] ..... F24F 13/062

[52] U.S. Cl. ..... 454/284; 285/4; 285/177; 454/300

[58] Field of Search ..... 98/40.05, 40.1, 40.12, 98/40.13; 285/4, 177, 176

[56] References Cited

U.S. PATENT DOCUMENTS

| | | | |
|---|---|---|---|
| 3,618,986 | 11/1971 | Todavich | 285/4 |
| 3,866,950 | 2/1975 | Skoch et al. | 285/4 |
| 4,175,936 | 11/1979 | Lough et al. | 98/40.05 X |
| 4,297,525 | 10/1981 | Bowden | 174/58 |
| 4,858,520 | 8/1989 | Prochnow et al. | 98/114 |

*Primary Examiner*—Harold Joyce

[57] ABSTRACT

An air diffuser assembly having multiple, various size inlet collars joined together with frustum shaped sections. Each of these sections contain a tear-away band around its perimeter which allows removal of unneeded collar sections. The assembly is mounted using a number of quick mounting clips.

7 Claims, 7 Drawing Sheets

ADJUSTABLE AIR DIFFUSER WITH QUICK MOUNTING MEANS

BACKGROUND

1. Field of the Invention

This invention relates to air diffusers used in air distribution systems, specifically to improvements in method of installation, and adaptability to various size air ducts.

2. Description of Prior Art

Heretofore, installers of heating, air conditioning, and other types of air distribution systems would install an air diffuser in the following manner. A hole, slightly larger than the size of the opening (inlet) of the diffuser would be cut in the material (gypsum board, plaster, etc. in which the diffuser would be installed. A diffuser box, having one open end the same size as this hole, and a flange around this open end, would be placed into the hole from either side of the material and fastened in this position. The diffuser would then be placed over this prepared opening, and screws would be installed, through the screw holes in the diffuser, and into the flange of the diffuser box (usually requiring pre-drilling). In one of the remaining sides of the diffuser box, would be a hole or collar to accept the incoming air duct. This process is complicated and requires extensive labor.

U.S Pat. No. 4,858,520 to Prochnow and Burke (1989) describes one improvement to part of this process. It features a pre-fabricated housing with a plurality of lanced tabs which are driven outward into framework. However, this requires framework to support the assembly.

An improvement to the inlet portion of the diffuser box, cited in U.S. Pat. No. 3,866,950 to Skoch, Sigfried, and Slogick (1975) uses a multiple step configuration to receive a variety of air duct sizes. When connecting ducts larger than the smallest step, the unused portion is removed by breaking or cutting along a groove of reduced wall thickness. This is difficult to do without cutting, or removing needed portions. Because of the location of these grooves, further reduction of wall thickness (to make cutting easier) would substantially weaken the assembly.

A reference to a pawl mounting device (clip) exists in U.S. Pat. No. 4,297,525 to Bowden (1981). Although used on electrical boxes, this exact arrangement used on a larger or heavier structure would require additional support for the mounting screw, to eliminate any side to side movement of the mounting screw.

OBJECTS AND ADVANTAGES

Accordingly, several objects and advantages of our invention are:

(a) to provide an improved assembly with provisions for adapting to various sized duct openings.

(b) to provide for a quick, easy means of installation with no additional framework or necessary preparation.

(c) to provide a means of adapting various shaped diffusers to various shaped openings (example: a more commonly used square diffuser mounted in a more easily formed round opening.)

(d) to provide for easier alignment between duct and diffuser box assembly during installation.

(e) to provide a method by which a rectangular diffuser can be rotated to a position square with room partitions after installation.

Further objects and advantages are to provide a diffuser box assembly which can be easily handled, installed, and produced, to cut costs, and reduce labor. Still further objects and advantages will become apparent from a consideration of the ensuing description and drawings.

DRAWING FIGURES

In the drawings, different views of the same part(s) are identified by using the same numeral with different alphabetic suffixes.

FIGS. 1A to 1C display various perspectives of the invention in its entirety.

REFERENCE NUMERALS IN DRAWINGS

Figure 1A:
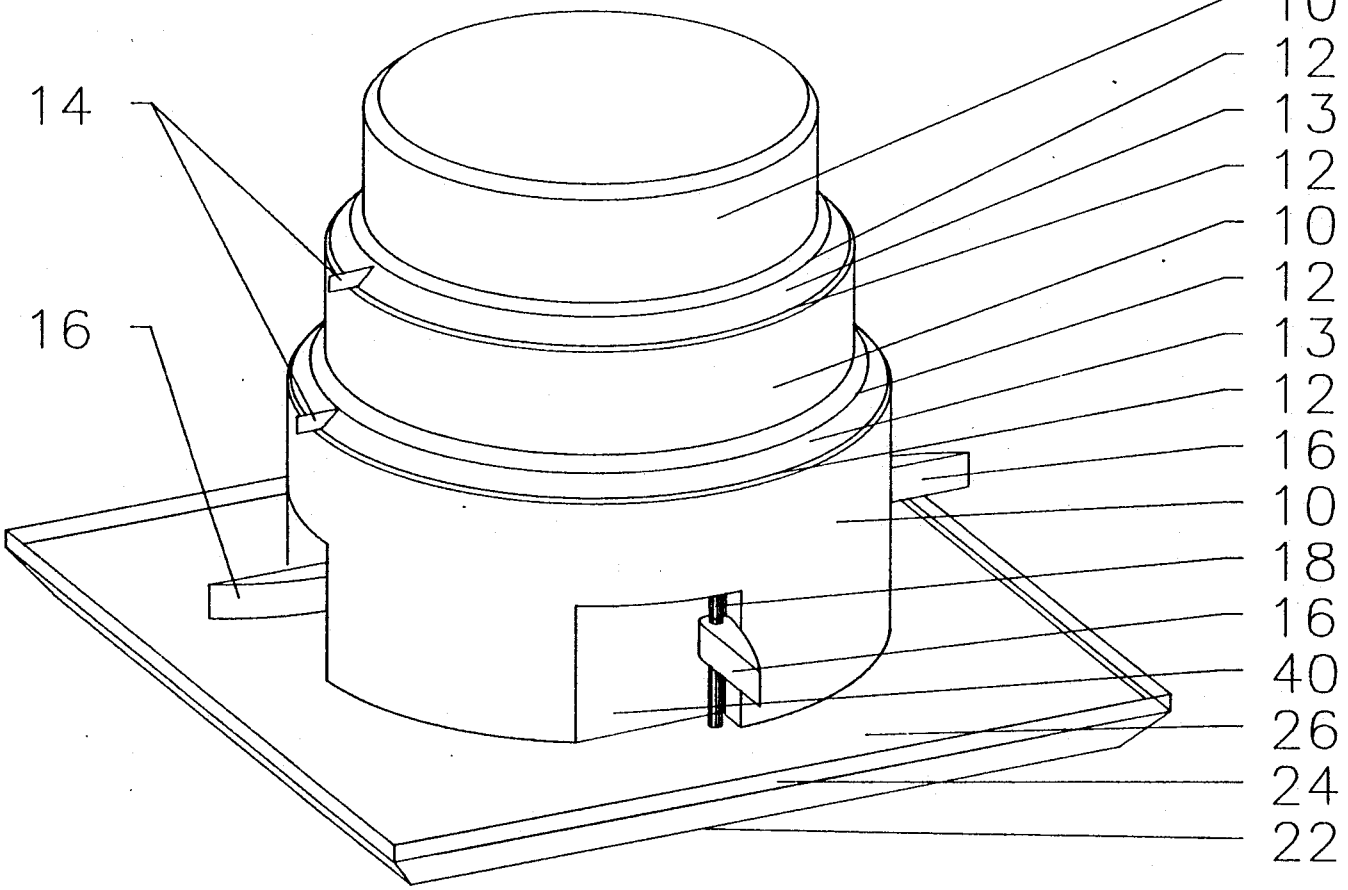

10: collar
12: groove
13: tear-away band
14: tab
16: clip
18: screw
20: hole
22: diffuser
24: lip
26: flange
28: head of screw
30: air deflecting fins
32: mounting surface material
34: frustum shaped member
36: tab gusset
38: tab groove
40: mounting clip cutout

DESCRIPTION—FIGS. 1A-1C, 2, 3, and 4

Figure 1B:
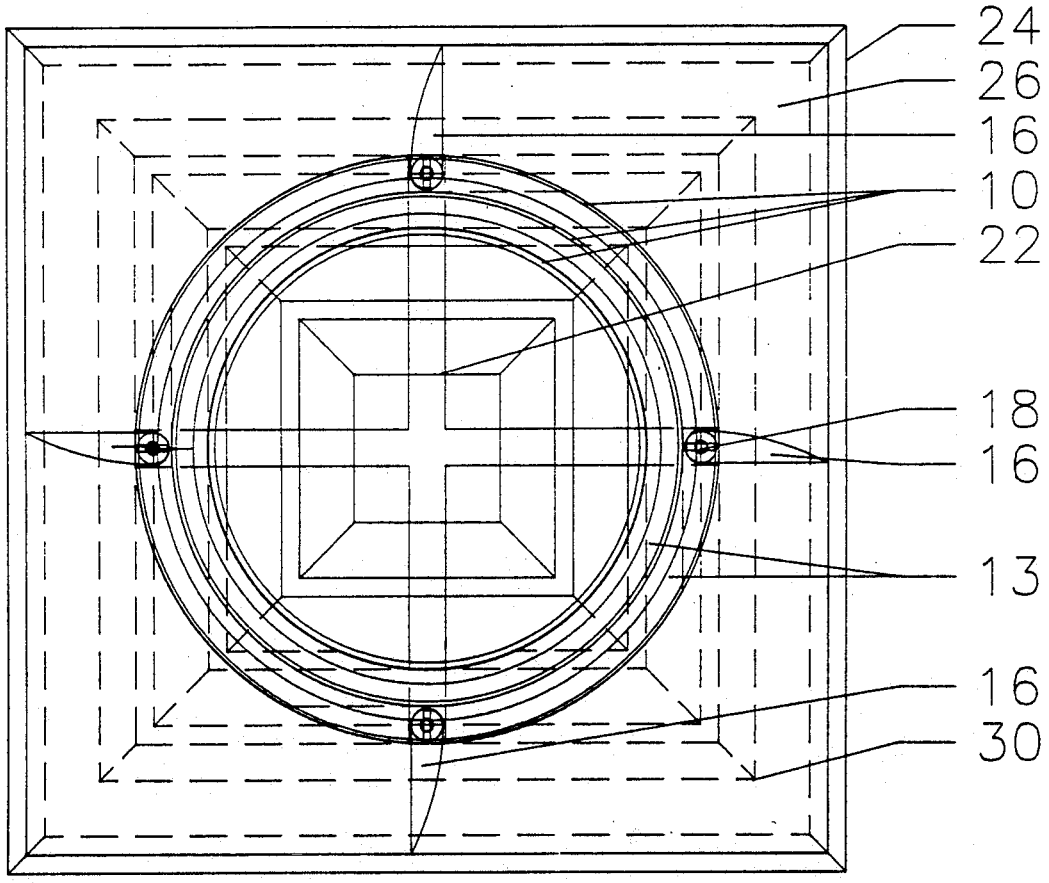
Figure 1C:
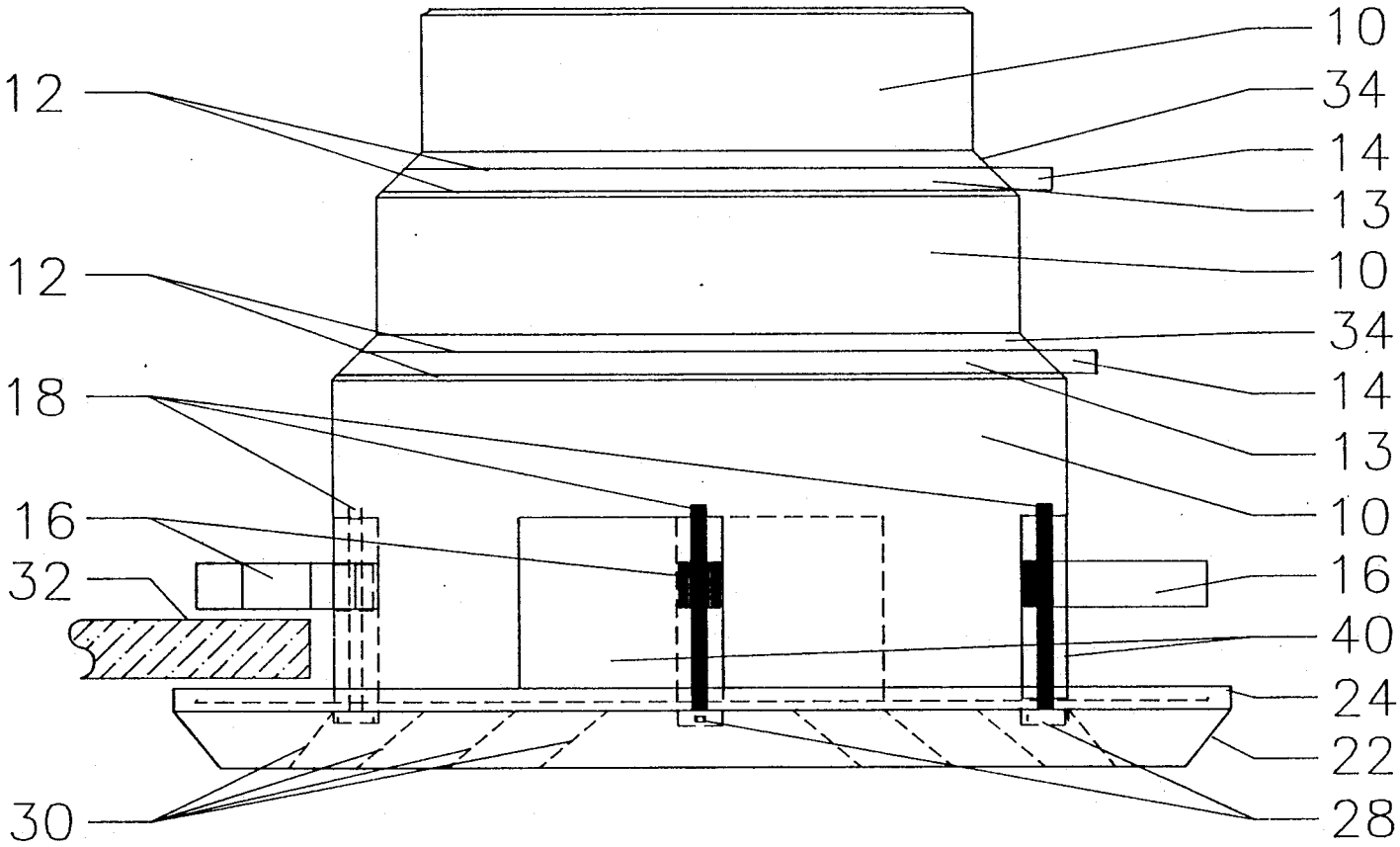
Figure 2A:
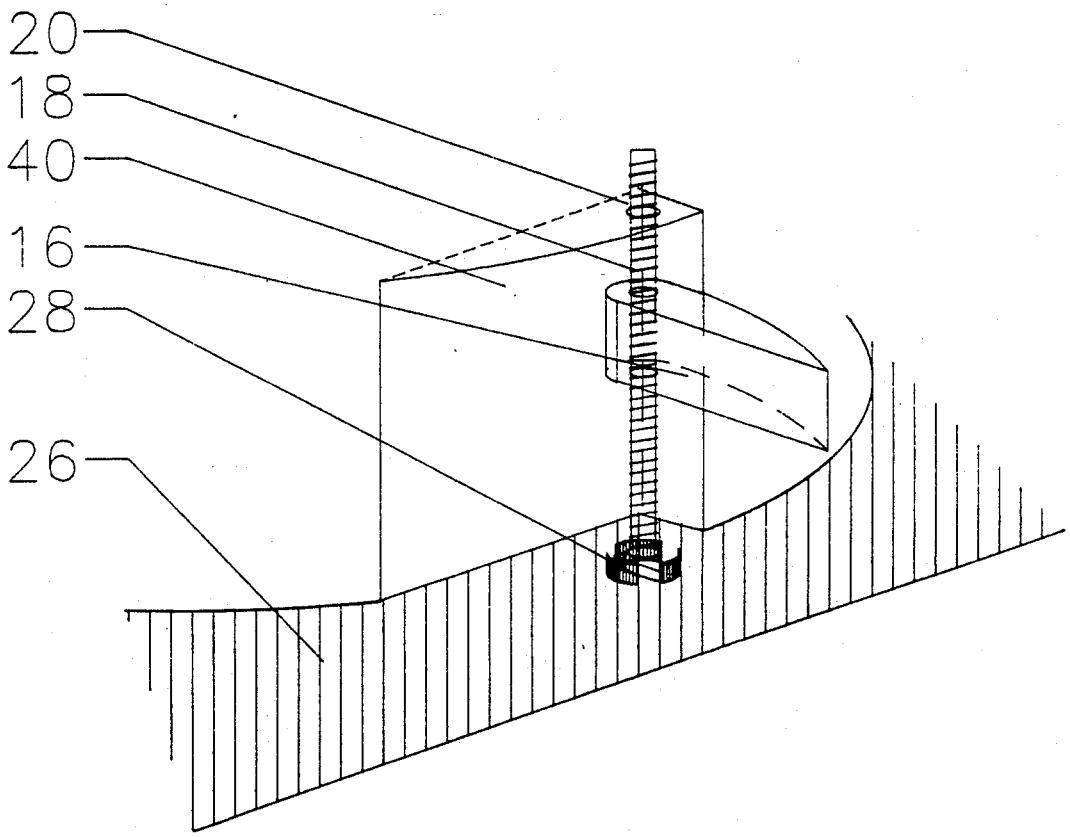
FIGS. 2A and 2B show detail views of the quick mounting clip assembly.
Figure 2B:
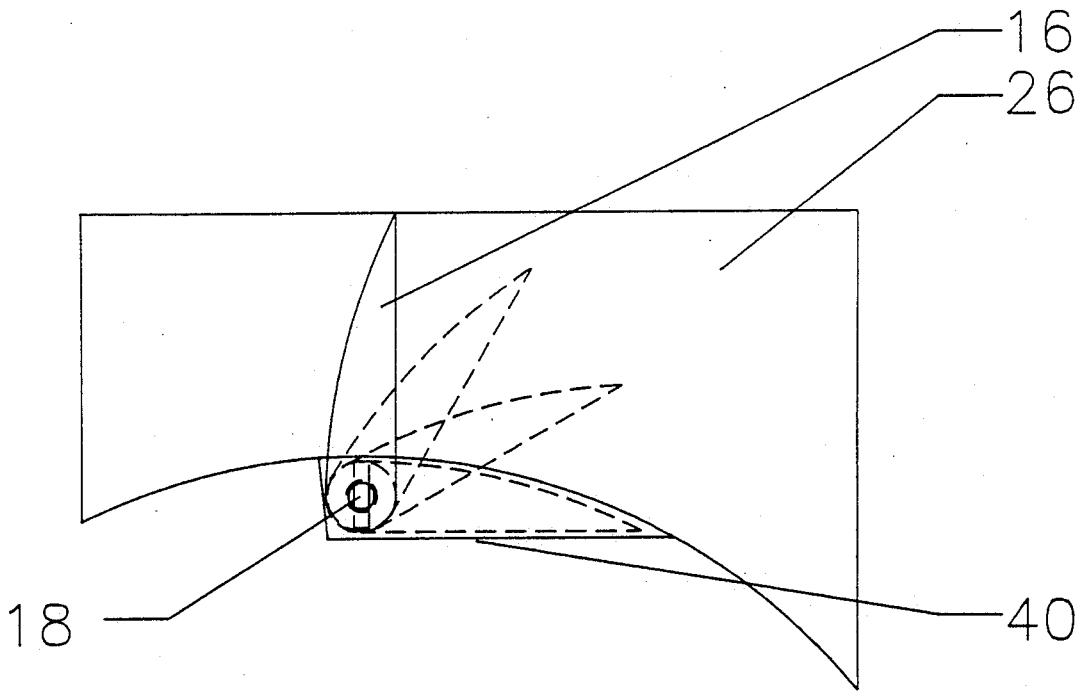
Figure 3:
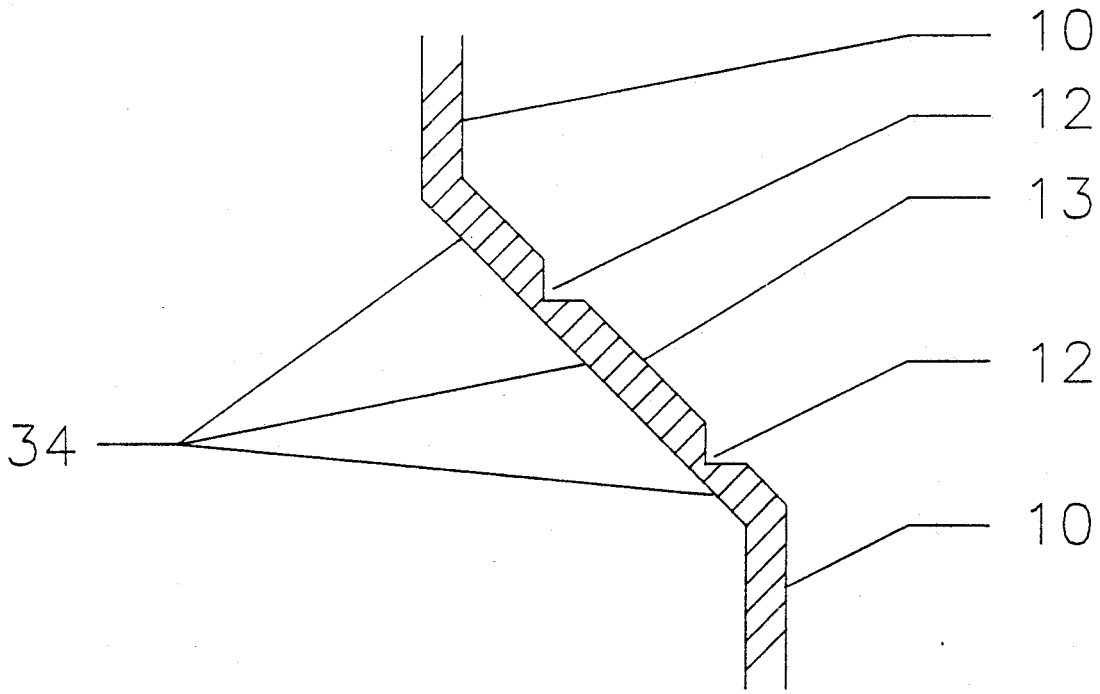
FIG. 3 shows a detail cross-section view of a removable band between two grooves, and a beveled neck to facilitate easier duct installation.
Figure 4:
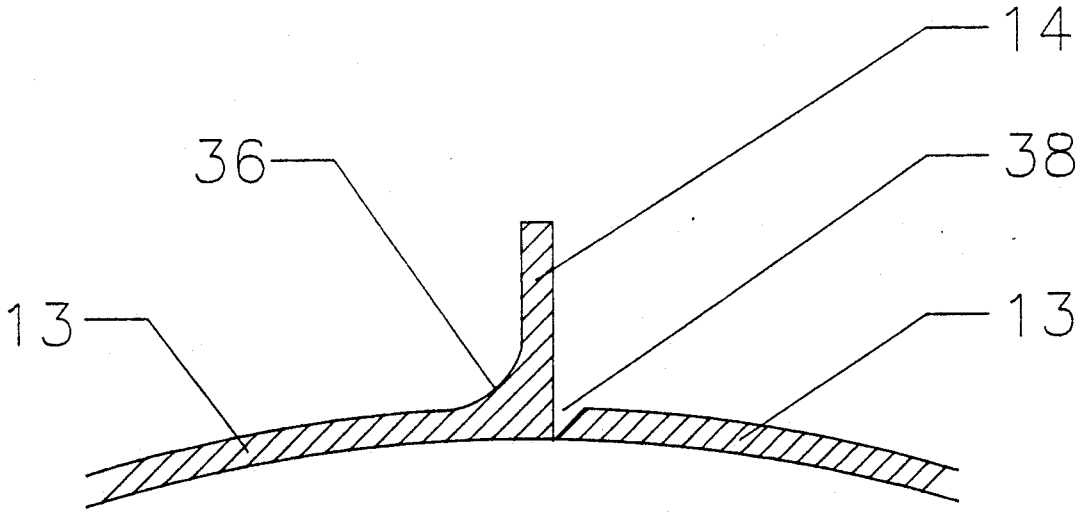
FIG. 4 shows a detail cross-section view of a tear-away band, tab gusset, and an area of reduced wall thickness to initiate removal.

Different views of the invention are shown in FIG. 1A (3D, or isometric view), FIG. 1B (top, or plan view) and FIG. 1C (front or elevation view). A plurality of tubular shaped parallel collars 10 of different common duct sizes are arranged in an angular stepped configuration leaving the largest collar 10 adjacent to the mounting surface material 32. These collars 10 are of sufficient length to accommodate easy duct installation. In addition to this length, the largest collar 10 incorporates enough length to provide for a mounting clip cutout 40 to house the mounting clip 16 assembly. Each collar 10 is joined by a frustum shaped member 34 which connects collars 10 of different sizes. An alternating series of collars 10 and frustum shaped members 34 create the portion of the invention which is to be used for duct connection.

Located within the boundaries of the frustum shaped members 34 is a smaller frustum shaped tear-away band 13 of material defined by two parallel v-shaped grooves 12 each having an area of reduced wall thickness. A tab 14 is located at one point along the frustum shaped band 13. This tab 14 is of sufficient size to enable grasping with fingers, pliers or other grasping type tool. Adjacent to this tab 14, a tab gusset 36 is located to strengthen the tab 14 on one side. This tab gusset 36 is positioned perpendicular to, but not interfering with the two parallel v-shaped grooves 12. Located on the opposite side of the tab 14, perpendicular to and connecting the parallel v-shaped grooves 12 is a tab groove 38 with wall thickness reduced enough to facilitate easy separation.

A plurality of clip mounting cutouts 40 are located at equal distances along the circumference of the largest collar 10. The clip mounting cutouts 40 are of sufficient size and shape to effectively house each screw 18 and mounting clip 16 in a closed position. Each mounting clip's 16 length is curved to an arc equal to the arc of the largest collar. The clips 16 are of sufficient thickness and height to support the weight of the entire invention without distortion. A hole is bored through one end of the clip 16 transverse to the longest dimension, and parallel to the axis of the arc.

A flange 26, extending outward ninety degrees from and encircling the outlet end of the largest collar 10, has a rectangular outer configuration. This flange extends outward to a size slightly less than the overall diffuser 22 size. The diffuser 22 is attached to this flange. Its exact design is not important, but includes a rectangular outer mounting frame, sealing lip 24 extending upward from its outer rim, and a plurality of air deflecting fins 30 of sufficient size, quantity, and orientation to direct the exiting air in the desired direction(s).

A plurality of mounting screws 18 extend through the diffuser 22, the flange 26, the mounting clip 16, and are of sufficient length to enter a hole in the top of the mounting clip cutout 40.

The invention described and illustrated herein may be manufactured using a low cost moldable material, preferably plastic (such as ABS, polyvinyl chloride, or polyethylene). Certain parts of the invention, namely clips 16 and screws 18 may be manufactured from other more suited (higher strength) types of material such as steel or aluminum.

OPERATION—FIGS. 1A-1C, 2, 3, and 4

The method of installing the present invention, and the function of its parts is described below. After determining the location for the air diffuser FIGS. 1A-1C within a room, a hole, slightly larger than the size of the largest collar 10, is cut through the mounting surface material 32 (such as gypsum board, plaster, etc.). The invention is placed into the hole, with the inlet, or collar 10 end first, leaving the diffuser 22 facing the living space. As the mounting screws 18 are tightened, the first ninety degrees of rotation will hinge the mounting clips 16 to an open position (facing outward). This hinging movement of the clip 16 is caused by friction between the walls of the mounting clip 16 hole and the outer . diameter of the screw 18. After completely hinging ninety degrees outward, the clip 16 lodges itself against a wall of the clip mounting cutout 40 holding it in this position. As the screw 18 is further tightened, the clip 16 is drawn against the back side of the surface mounting material 32, causing the diffuser and the clip to "sandwich" the surface mounting material 32. Unwanted horizontal movement of the screw 18 and subsequent misalignment of the clip 16 assembly is prevented by the hole in the top of the clip mounting cutout 40 which guides the tip of the screw 18. Before final tightening, the invention may be rotated within the hole to a position square with room partitions.

After determining the duct size to be connected, all smaller collar 10 sections must be removed to prevent obstruction of the airway. This is done by grasping a tab 14 between the desired collar 10 and the next smaller sized collar with fingers, or an appropriate grasping tool. The tab 14 is pulled or twisted to initiate a cut or separation within the v-shaped grooves 12. Further pulling of this tab 14 progressively removes the tear-away band 13, separating the unneeded collar 10 sections for removal. Removal of these unneeded collar 10 sections reveals a beveled edge (remaining portion of the frustum shaped member 34) with a slightly reduced opening diameter. This beveled edge greatly assists in aligning and insertion of a collar 10 into ductwork, and significantly strengthens the collar 10. After installing the duct over the collar 10, it may be secured in this position by a strap, clamp, or other suitable means.

It is to be understood, that the above described operation may be performed in an order deemed most convenient to the particular situation.

SUMMARY, RAMIFICATIONS, AND SCOPE

Accordingly, the reader will see that the adjustable air diffuser with quick mounting means provides a quick, easy solution to the complicated process of installing an air diffuser. It provides for a simple, quick fastening device which requires no tedious alignment or pre-drilling. Using a round hole, the invention remains easily adjustable which eliminates the problem of correctly positioning a widely used rectangular diffuser square to room partitions.

The invention provides for a fail safe method of removing unwanted collar sections without the use of sharp instruments, accidental ijjury, damage to the assembly, or significant weakening of the structure. The invention eliminates a labor intense, traditional two step mounting process (mount box, then mount diffuser) by incorporating a diffuser pre-mounted to the box assembly.

Although the description above contains many specifities, these should not be construed as limiting the scope of the invention but as merely providing illustrations of some of the preferred embodiments of this invention. For instance the diffuser box assembly can have other shapes such as circular, oval, rectangular etc.

We claim:

1. An air diffuser assembly comprising:

(a) a plurality of collars, having sufficient size and length to accommodate connection of standard size air ducts, connected end to end by frustum shaped members and, (b) each said frustum shaped member containing a tear away band of material located between two grooves of reduced wall thickness, along its perimeter and, (c) a tab located at one point along said tear away band to initiate removal of said band hereby removing unneeded said collars and, (d) a flange, mounted transversely adjacent to the lower end perimeter of the largest of said collars to receive diffuser grille.

2. The assembly of claim 1 wherein the largest of said collars has sufficient length to provide a means of housing a plurality of fastening means.

3. The assembly of claim 2 wherein said fastening means comprises a plurality of clips to fasten the device to a mounting surface with said clip having a screw passing through said clip enabling said clip to rotate to a position directly behind a mounting surface material and further rotating said screw to guide said clip along a path parallel to said screw, causing said clip to contact the reverse side of said mounting surface material, whereby holding the device in a fixed position.

4. The assembly of claim 3 wherein the tip of said screw is situated within a hole so as to prevent unwanted horizontal movement.

5. The assembly of claim 1 wherein a diffuser grille comprises blades to direct air passing through said grille in a particular direction and a mounting means with which to attach said grille to said flange.

6. The assembly of claim 1 wherein said flange has an inner circular shape and an outer rectangular shape.

7. The assembly of claim 1 wherein said tear away band of material is situated so as to leave an exposed beveled edge of material after said tear away band of material is removed enabling easy installation of said air duct.

* * * * *